US010807121B2

(12) United States Patent
Schmid et al.

(10) Patent No.: US 10,807,121 B2
(45) Date of Patent: Oct. 20, 2020

(54) METHOD AND DEVICE FOR COATING WORKPIECES

(71) Applicants: Homag GmbH, Schopfloch (DE); Homag Kantentechnik GmbH, Lemgo (DE)

(72) Inventors: Johannes Schmid, Starzach-Wachendorf (DE); Ralf Garnjost, Lemgo (DE)

(73) Assignees: HOMAG GmbH, Schopfloch (DE); HOMAG KANTENTECHNIK GmbH, Lemgo (DE)

( * ) Notice: Subject to any disclaimer, the term of this patent is extended or adjusted under 35 U.S.C. 154(b) by 32 days.

(21) Appl. No.: 14/418,976

(22) PCT Filed: Jul. 16, 2013

(86) PCT No.: PCT/EP2013/064990
§ 371 (c)(1),
(2) Date: Feb. 2, 2015

(87) PCT Pub. No.: WO2014/019847
PCT Pub. Date: Feb. 6, 2014

(65) Prior Publication Data

US 2015/0239009 A1 Aug. 27, 2015

(30) Foreign Application Priority Data

Aug. 3, 2012 (DE) ..... 10 2012 213 796

(51) Int. Cl.

| | |
|---|---|
| ***B05D 3/04*** | (2006.01) |
| ***B05D 3/10*** | (2006.01) |
| ***B27D 5/00*** | (2006.01) |

(52) U.S. Cl.
CPC ..... *B05D 3/0473* (2013.01); *B05D 3/0406* (2013.01); *B05D 3/104* (2013.01); *B27D 5/003* (2013.01)

(58) Field of Classification Search
None
See application file for complete search history.

(56) References Cited

U.S. PATENT DOCUMENTS 3,673,761 A * 7/1972 Leitz ..... B29C 66/83411 215/252
4,222,812 A 9/1980 Duewel
(Continued)

FOREIGN PATENT DOCUMENTS

DE 1621814 * 5/1973
DE 3415747 A1 9/1985
(Continued)

OTHER PUBLICATIONS caplus and wpix abstracts of EP1852242, Nov. 2007.*
(Continued)

*Primary Examiner* — Francisco W Tschen
(74) *Attorney, Agent, or Firm* — Morgan, Lewis & Bockius LLP

(57) ABSTRACT

The invention relates to a method for coating workpieces, which preferably consist at least sectionally of wood, wood-based materials, plastics material or the like, with a coating material, wherein the method includes the steps of: providing a functional layer, which can be rendered adhesive by energy input, supplying a coating material to the workpiece to be coated, at least partially activating the functional layer by treating the functional layer with a heated gas, wherein the heated gas is emitted onto the functional layer via at least one outlet opening and is at a positive pressure of at least 1.5 bar in a region of the at least one outlet opening, and joining
(Continued)

the coating material to the workpiece by means of the activated functional layer.

7 Claims, 2 Drawing Sheets

(56) References Cited

U.S. PATENT DOCUMENTS

| | | | | |
|---|---|---|---|---|
| 4,832,589 | A * | 5/1989 | Gini | B29C 47/0023 264/171.26 |
| 4,944,829 | A * | 7/1990 | Tuttle | B65B 61/00 156/320 |
| 8,863,804 | B2 | 10/2014 | Gauss | |
| 8,945,333 | B2 | 2/2015 | Schumacher | |
| 9,302,279 | B2 | 4/2016 | Kluge | |
| 2009/0311473 | A1* | 12/2009 | Husemann | C09J 7/0242 428/137 |
| 2010/0022375 | A1* | 1/2010 | Colla | B31B 19/00 493/243 |
| 2011/0124776 | A1* | 5/2011 | Grolman | B01J 8/12 524/1 |
| 2011/0183122 | A1* | 7/2011 | Schumacher | B27D 5/003 428/192 |
| 2012/0159922 | A1* | 6/2012 | Gurin | F01K 23/06 60/39.15 |
| 2012/0328824 | A1* | 12/2012 | Cartabbia | A41D 27/245 428/104 |
| 2014/0014266 | A1* | 1/2014 | Schulte-Goebel | B27D 5/003 156/309.9 |

FOREIGN PATENT DOCUMENTS

| | | | | |
|---|---|---|---|---|
| DE | 10342723 | A1 | 8/2005 | |
| DE | 102010020293 | | 11/2011 | |
| DE | 102012103508 | | 7/2013 | |
| EP | 0897781 | A2 | 2/1999 | |
| EP | 1163864 | A1 * | 12/2001 | A47B 96/201 |
| EP | 1800813 | A2 | 6/2007 | |
| EP | 2412501 | | 2/2012 | |
| EP | 2433769 | | 3/2012 | |
| EP | 2694272 | | 2/2014 | |
| EP | 2782725 | | 10/2014 | |
| WO | WO2012130224 | * | 10/2012 | B29C 63/00 |

OTHER PUBLICATIONS

Lommatzch et al., Atmospheric Pressure Plasma Jet Treatment of Polyethylene Surfaces for Adhesion Improvement, Plasma Process. Polym. 2007, 4, S1041-S1045 (Year: 2007).*

International Search Report, dated Aug. 16, 2013, with respect to International Application No. PCT/EP2013/064990.

English translation of International Preliminary Report on Patentability, dated Oct. 30, 2014, with respect to International Application No. PCT/EP2013/064990.

German Search Report dated Apr. 23, 2013 with respect to priority German application No. 10 2012 213 796.3.

European Search Report dated Feb. 2, 2017 with respect to parallel European patent application No. 13 741 99.6—cited only for references that are disclosed therein.

* cited by examiner

METHOD AND DEVICE FOR COATING WORKPIECES

TECHNICAL FIELD

The invention relates to a method with a device for coating workpieces which preferably consist at least sectionally of wood, wood-based materials, plastics or the like, with a coating material using hot gas.

PRIOR ART

Methods and devices of the type cited initially are widely used in the prior art, in particular in the furniture and construction element industries. For a long time it was usual to supply to a workpiece a coating material, such as an edging, pre-coated with an adhesive, then to melt the adhesive and stick the coating material to the workpiece. To melt the adhesive, various means were used, for example heating elements of all types, hot air or the like.

However it has been shown that this traditional method only allows limited production speeds. In addition, the requirements for quality and the optical appearance of the joints between coating material and workpiece have risen ever higher, so that the traditional methods often no longer meet these requirements.

In this context, in recent years various novel energy sources have been researched and brought to market maturity for activating the adhesive between the workpiece and the coating material. For example, EP 1 800 813 discloses a method and a device for coating components using a laser. Alternatively, however, different technologies have also been developed, such as for example the use of plasma or ultrasound to activate the adhesive (see for example WO 2010/009805). In addition, progress has been made in the adhesive connection itself as frequently, instead of a pure melt adhesive, a functional layer (often based on melt adhesive) is used which is dyed very precisely to the same colour as the coating material and therefore is scarcely visible in joined state. This gives the observer the impression that there is a "jointless" connection.

These newer technologies are also suitable for high production rates. However, the newer technologies require a relatively complex construction and comparatively high investment costs, in particular for the energy sources for activating the functional layer. In addition, depending on energy source, a custom-made functional layer is usually required which entails additional complexity.

Representation of the Invention

The object of the present invention is therefore to provide a method and a device of the type cited initially which, with simple construction and low investment costs, allow a high-quality joint connection between a coating material and a workpiece.

This object is achieved according to the invention by a method according to claim 1. Particularly preferred embodiments of the invention are given in the dependent claims.

The invention is based on the concept of working with a comparatively simple energy source for activating a functional layer to become adhesive, and using this source effectively such that modern requirements for high-quality joint connection and an economic production process are also fulfilled.

To this end, in the method according to the invention, it is proposed that the functional layer is activated at least partially by treatment with a heated gas, the heated gas being emitted to the functional layer via at least one outlet opening, and in the region of the at least one outlet opening has a positive pressure, preferably a pressure of at least 1.5 bar, particularly preferably a pressure of at least 3 bar.

By the use of hot pressurised gas as an activation means for the functional layer, within the context of the invention it is possible to work with a relatively simple energy source requiring low investment cost. At the same time, this energy source is however suitable for activating a very wide range of functional layers, in particular also so-called neutral joint functional layers which would otherwise require the use of a more complex energy source, such as for example a laser or plasma source. The emission of the hot gas with a positive pressure to the functional layer also allows a higher energy input into the respective functional layer. This not only allows working at comparatively high production speeds, but also constitutes an essential factor for being able to activate special functional layers by means of hot air.

Frequently the functional layers used have a very short "working time", so that the functional layer can only be activated within a very short time window before the joining process. Within this short time window, activation of the functional layer is possible only in that according to the invention, thanks to the positive pressure, an increased energy input into the functional layer takes place. The method according to the invention therefore allows for the first time the processing of the latest generation of functional layers—as used for example for zero joint technology—by means of hot air.

According to a further development of the invention, it is provided that in the region of the at least one outlet opening, the gas has a temperature of at least 300° C., preferably 350° C. In this temperature range there is a sufficiently high energy input without having to fear damage to the functional layer to be activated. Thus the advantages of the invention explained above can be achieved in a particularly pronounced and efficient fashion.

In addition, according to a further development of the invention, it is provided that the at least one outlet opening has a distance from the functional layer of maximum 10 mm, preferably maximum 4 mm, in particular 2 mm. This comparatively short distance not only ensures that no undesirable cooling of the emerging hot air occurs. Rather the comparatively small distance between the functional layer and the outlet opening also contributes to the build-up of a back-pressure in the region of the outlet opening, which allows an increased energy input into the functional layer. As a result therefore an essential contribution is made to achieving the advantages described above.

In addition, according to a further development of the invention, it is provided that several outlet openings are provided, the gas having different temperatures in the region of at least two outlet openings, which temperatures increase preferably in the direction of a relative movement between the outlet openings and the functional layer to be activated. By the provision of several outlet openings, not only can an increase in the energy input be achieved but the energy input can be adapted particularly advantageously to the respective peripheral conditions of the jointing process. This is the case in particular when the gas has different temperatures in the region of at least two outlet openings. In this way, a pre-heating of the functional layer can be achieved, for example, by means of a first outlet opening before this is then melted fully in the region of a second outlet opening. Thus a deterioration of the functional layer, or perhaps also of the coating material or even the workpiece, may be avoided and advantageously an optimum adhesion capacity of the functional layer may be achieved.

In the context of the invention, the functional layer may be configured in widely varying ways and in principle also be formed as a simple melt-adhesive layer or the like. With regard to the activation with hot air, according to a further development of the invention it is, however, provided that the functional layer comprises means for increasing the thermal conductivity, such as in particular low-melt polyolefins and/or metal particles. This allows the thermal energy supplied by means of hot air to penetrate also sufficiently rapidly and deeply into the functional layer, resulting in complete activation of the functional layer with a correspondingly optimised adhesive connection.

In addition, according to a further development of the invention, it is provided that the functional layer is substantially free from absorbers for laser light or other radiation sources. This further development is based on the knowledge that functional layers tailored, for example, for lasers are complex and costly to produce, since special absorbers for laser light must be included as buffers in order for it to be possible to activate the functional layer by means of a laser (or other comparable radiation source). Advantageously, no such additional measures are required in the context of the invention since activation of the functional layer by means of high pressure gas requires no such absorbers. Consequently this means that processing can be achieved by functional layers which can be produced significantly more simply and more economically.

According to a further development of the invention, it is furthermore provided that the gas supplied to the coating material is at least partially recovered and used at least indirectly, in particular via a heat exchanger, for heating the supplied gas flow. In this way the economical efficiency and environmental friendliness of the method according to the invention can be significantly increased. In addition, recovery of the gas helps avoid excessive heating of the machining environment, which could have a disadvantageous effect on the coating process.

According to a further development of the device according to the invention, it is provided that in the region of the at least one outlet opening, means are provided for forming a turbulent flow on emergence of the heated pressurised gas. The energy supply to the functional layer to be activated may be increased by this further with little effort, so that the advantages cited above become even more pronounced. It is particularly preferred if at least one outlet opening is formed as a nozzle with variable cross section. Such a nozzle constitutes a particularly simple but nonetheless effective means for forming a turbulent flow.

According to a further development of the device according to the invention, it is furthermore provided that the pressurised gas source comprises a heat exchanger portion which is configured to heat the supplied pressurised gas to a temperature of at least 450° C., preferably at least 600° C. Firstly, the provision of a separate heat exchanger portion helps allow the device according to the invention to function autonomously, it being a feature according to the invention that the heat exchanger portion may be supplied with pressurised gas from a pressurised gas source, i.e. be suitable for heat exchanger operation under pressure.

As a whole, the pressurised gas at the preferred temperature of 450° C. or even 600° C. has a high energy density, and consequently pressure and temperature, which allows the desired high energy input to the functional layer. The pressurised gas is advantageously heated to a comparatively high temperature so that later heat losses en route to the outlet opening are harmless, and where applicable cold pressurised gas can even be mixed into the process.

Although the device according to the invention may also be supplied by an external pressurised gas supply, according to a further development of the invention it is provided that the pressurised gas source of the device comprises a pressurised gas generating unit. In this way, the pressurised gas generation and heating may be matched to each other particularly advantageously, and allow autonomous operation of the device according to the invention.

To avoid excessive heating of the working environment, according to a further development of the invention it is provided that in the region of the outlet opening, a material with low thermal conductivity and/or low heat storage capacity is provided. In this way it is ensured that no heat-induced deterioration occurs of the coating material, the functional layer or the workpiece as a result of excessive ambient temperature, which as a whole contributes to a reliable coating process and a high-quality coating result. For the same reasons, according to a further development of the invention, it is also provided that the supply device for supplying the coating material is thermally insulated at least in portions.

According to a further development of the invention, it is furthermore provided that the device has a discharge device which is configured to discharge at least part of the gas supplied to the coating material and preferably also to recover this, for example via a heat exchanger for heating the supplied gas flow. In this way, the advantages discussed above in connection with the recovery of gas may be achieved.

The heat exchanger portion in the context of the present invention may be configured in widely varying ways. According to a further development of the invention however, it is provided that the heat exchanger portion has at least one heat exchanger element which is provided with voids, is in particular porous and/or bulk-porous and/or is provided with continuous openings, since it is connected to a heating source. This allows a particularly efficient and hence economic and environmentally-friendly production of the hot compressed air with simple construction.

It is particularly preferred in this respect that at least one heat exchanger element consists at least in sections of a material which is selected from stainless sinter metal, porous ceramics, metal foam, in particular aluminium foam, and combinations thereof. These materials not only allow a very good heat transfer between the heating source and the air to be heated, but also have a high durability and are easy to work.

According to a further development of the invention, it is furthermore provided that the heating source has heating elements which are selected from heating cartridges, ceramic heating elements, high current heaters, lasers, infrared sources, ultrasound sources, magnetic field sources, microwave sources, plasma sources and gas-treatment sources. These different heat sources or combinations thereof may advantageously be selected, depending on the respective requirements and ambient conditions, to achieve the desired thermal output with optimum economic efficiency and environmental friendliness.

Furthermore, according to a further development of the invention, the device may have a second pressurised gas source which is configured to feed-in a pressurised gas upstream of the at least one outlet opening, in order to increase the pressure of the gas emerging at the at least one outlet opening. This configuration is advantageous in particular if the heat exchanger portion is able to heat the pressurised gas to a significantly higher temperature than that required at the outlet opening. In this case, by mixing-in a further pressurised gas, a higher volume flow and/or higher pressure can be achieved in the hot pressurised gas emerging at the outlet opening, again resulting in an increased energy input into the functional layer to be activated.

DETAILED DESCRIPTION OF PREFERRED EMBODIMENTS

Preferred embodiments of the invention are described below in detail with reference to the accompanying drawings.

Figure 1:
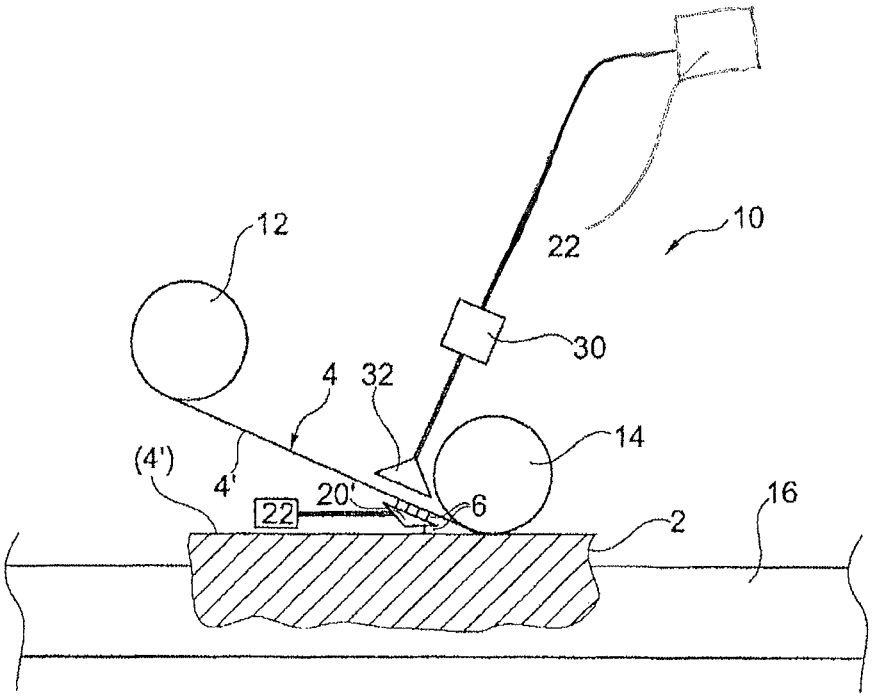
FIG. 1 shows diagrammatically a top view of an embodiment of the device according to the invention.

A device 10 for coating workpieces 2 according to a preferred embodiment of the present invention is depicted diagrammatically in top view in FIG. 1. Although the device 10 according to the invention may be used for coating widely varying workpieces, it is preferably used for coating workpieces which consist at least in sections of wood, wood-based materials, plastics or the like, as are widely used in the kitchen, furniture and construction element industries. Any surfaces such as narrow or broad surfaces can be coated.

The coating material 4 may also be selected from widely varying materials, preferably a coating material provided with a functional layer 4' being used. The functional layer 4' may also be an integral part of the coating material 4, for example in the sense of a coextruded or fully monolithic coating material. Alternatively or additionally, it is also possible that the functional layer 4 is already provided on the surface of the workpiece to be coated and/or is supplied separately to the area between the coating material 4 and the surface of the workpiece 2 to be coated.

The functional layer 4' in the present embodiment deploys its adhesive properties by the input of energy (such as for example heating) so that the coating material can be joined to the workpiece. The joining effect may be based fully or partly on other mechanisms. Furthermore in the present embodiment, the functional layer may comprise means for increasing the thermal conductivity, such as for example low-melt polyolefins and/or metal particles. Furthermore it is particularly preferred if the functional layer 4' is substantially free from absorbers for laser light or other radiation sources.

Furthermore the device 10 comprises a contact pressure device 14 for pressing the coating material 4 onto a surface of the workpiece 2, for example in the form of one or more contact pressure rollers. In the present embodiment, the supply device 12 for supplying the coating material 4 is thermally insulated at least in sections.

As shown in FIG. 1, the device 10 furthermore comprises a transport device 16 for generating a relative movement between the contact pressure device 14 and the respective workpiece 2, wherein the transport device 16 in the embodiment shown in FIG. 1 being configured as a continuous passage transport device (for example in the form of a conveyor chain). It must, however, be noted that the device according to the invention may also be configured as a stationary machine, in which the workpieces remain substantially stationary during the coating process and the transport device 16 serves for relative movement of the contact pressure device 14 and other components relevant for the coating process. Combinations of the two concepts are also possible. The decisive factor is the possibility of a relative movement between the contact pressure device 14 (or further components) and the respective workpiece 2, where applicable in several spatial directions or about one or more rotational axes. For this, various devices may be used such as conveyor belts, portals, but also robots and many others.

Immediately upstream of the contact pressure device 14, in the region between the coating material 4 and the surface of the workpiece 2 to be coated, an activation unit 20' is provided which in the present embodiment has plural outlet openings 20 for the supply of a heated pressurised gas 6 (or gas mixture such as air) to the respective functional layer 4'. Depending on the position of the respective functional layer 4', either on the coating material 4 or on the workpiece 2, the outlet openings 20 are oriented to the functional layer 4' accordingly. The outlet openings 20 have a distance from the respective functional layer 4' of maximum 10 mm, preferably maximum 4 mm, for example around 2 mm. It is, however, also possible that the activation unit 20', as indicated in FIG. 1, has corresponding outlet openings 20 in several directions, the respective outlet openings each being able to be switched on or off as required.

The outlet openings 20 of the activation unit 20' are connected to a pressurised gas source 22. The pressurised gas source 22 provides heated pressurised gas 6 to the respective outlet openings 20 such that a positive pressure is present in the region of at least one outlet opening 20. Advantageous values for the positive pressure present in the region of at least one (preferably all) outlet openings 20 are at least 1.5 bar, particularly preferably 3 bar.

Figure 2:
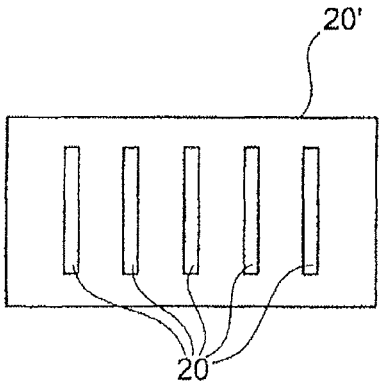
FIG. 2 shows diagrammatically a detail from FIG. 1.

One possible configuration of the activation unit 20' is depicted diagrammatically in side view in FIG. 2. FIG. 2 shows the side face of the activation unit 20' which is turned towards the functional layer 4' to be activated.

As shown in FIG. 2, in the present embodiment the activation unit 20' has plural outlet openings 20, where the gas may have different temperatures in the region of at least two outlet openings 20. Thus, for example, it is preferred that the temperature of the emerging pressurised gas rises in the direction of a relative movement between the outlet openings 20 and the functional layer 4' to be activated, i.e. in the present case in the passage direction (from left to right in FIG. 2). Irrespective of this, at least individual nozzles may have means for adaptation to the geometry of the functional layer to be activated. Furthermore, irrespective of the above embodiments, widely varying nozzle geometries may be used such as round, polygonal, elliptical etc.

Furthermore, in the region of one or plural outlet openings 20, means may be provided for forming a turbulent flow on emergence of the heated pressurised gas 6. Although not shown in FIG. 2, this may be achieved, for example, in that the respective outlet opening 20 is configured as a nozzle with an at least partially variable cross-section in the flow direction.

Furthermore, although also not shown in FIG. 2, in the region of the outlet opening(s) 20 a material with low thermal conductivity and/or low heat storage capacity may be provided.

Figure 3:
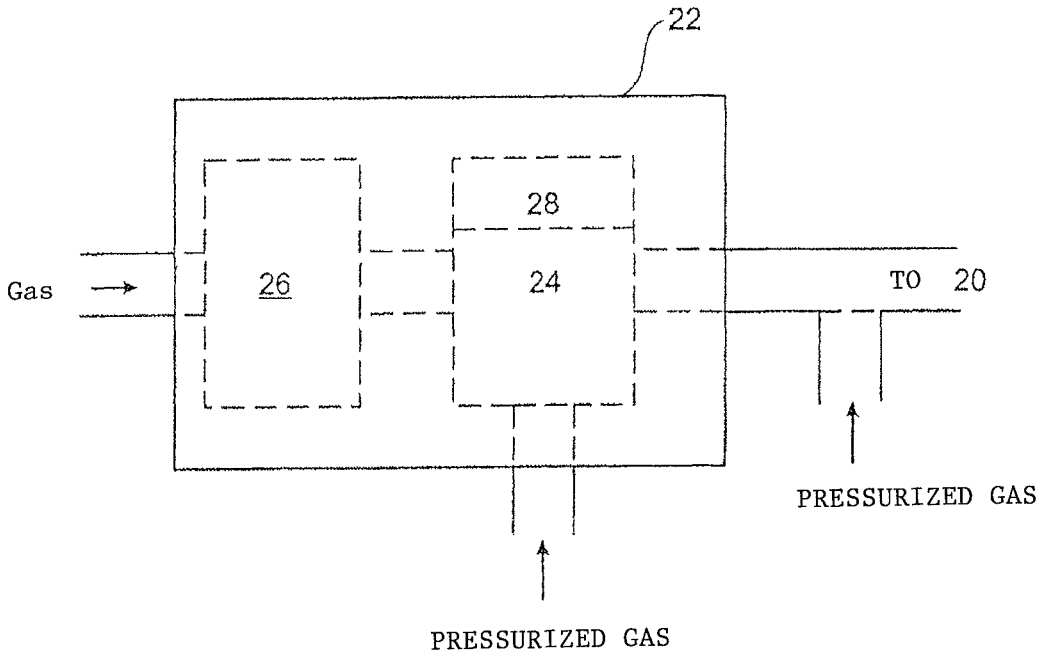
FIG. 3 shows diagrammatically a further detail from FIG. 1.

A preferred exemplary embodiment of the pressurised gas source 22 is shown diagrammatically in FIG. 3. In the present embodiment, the pressurised gas source 22 has a heat exchanger section 24 which is configured to heat the supplied pressurised gas to a temperature of at least 450° C., preferably at least 600° C. The system as a whole is designed such that in the region of the at least one outlet opening 20, the gas has a temperature of at least 300° C., preferably at least 350° C.

The heat exchanger section 24 may, for example, have at least one heat exchanger element which is provided with voids, is in particular porous and/or bulk-porous, and/or is provided with continuous openings, and which is connected to the heat source shown in FIG. 3. In the present embodiment, the heat exchanger element may at least in sections consist of a material which is selected from stainless sinter material, porous ceramics, metal foam, in particular aluminium foam, and combinations thereof. Evidently other suitable materials may also be used, in particular if they have a high thermal conductivity and/or high heat storage capacity.

In the present embodiment, the heat source 28 comprises heating elements, not shown in more detail, which may be selected, for example, from heating cartridges, ceramic heating elements, high current heaters, lasers, infrared sources, ultrasound sources, magnetic field sources, microwave sources, plasma sources and gas-treatment sources.

Furthermore, the pressurised gas source 22 in the present embodiment comprises a pressurised gas generating unit 26, for example in the form of a compressor. This may draw in gas to be compressed from the environment or from a gas supply, and transfer it to the heat exchanger section 24. Alternatively or additionally, the heat exchanger section 24 may also be supplied by an external, where applicable central, pressurised gas source, as shown in FIG. 3.

As is evident from FIG. 3, the device 10 according to the invention may furthermore comprise a second pressurised gas source which is configured to feed-in pressurised gas upstream of the at least one outlet opening (far right in FIG. 3), in order to increase the pressure of the gas emerging at the at least one outlet opening.

As most clearly visible on FIG. 1, the device 10 according to the invention furthermore comprises a discharge device 32, such as for example a capture hopper. In this way the gas supplied to the functional layer 4' may at least partially be discharged and preferably also recovered. To this end, as shown in FIG. 1, a heat exchanger 30 may be provided downstream of the discharge device 32, by means of which the waste heat from the gas supplied to the functional layer 4' may be captured and, for example, returned to the pressurised gas source 22 as thermal energy.

The operation of the device 10 according to the invention is performed, for example, as follows. A workpiece 2 to be coated is transported by means of the transport device 16 in a transport direction (from left to right in FIG. 1). In synchrony with this, a coating material 4 is supplied by means of the supply device. The functional layer provided on the coating material and/or workpiece (or separately) is activated by means of the heated pressurised gas 6 emerging from the outlet openings 20, immediately before the coating material is pressed by means of the contact pressure device 14 onto the surface of the workpiece 2 to be coated. Here the coating material 4 is joined to the workpiece 2 by means of the activated functional layer 4'.

The invention claimed is:

1. A method for coating a workpiece made at least sectionally of wood, wood-based materials, or plastics, with a coating material, wherein the method comprises the steps:

providing a functional layer which can be made adhesive by energy input, supplying the coating material from a thermally insulated supply device to the workpiece to be coated, at least partially activating the functional layer by treating the functional layer with a heated air, wherein the heated air is a fluid consisting of air and is emitted to the functional layer via at least one outlet opening and, in a region of the at least one outlet opening, the heated air has a positive pressure of at least 3 bar, and joining of the coating material to the workpiece by use of the activated functional layer, wherein the functional layer prior to activation is an integral part of the coating material, and wherein the functional layer and the coating material are coextruded.

2. The method according to claim 1, characterised in that in the region of the at least one outlet opening, the air has a temperature of at least 300° C.

3. The method according to claim 1, characterised in that the at least one outlet opening has a distance of a maximum of 10 mm from the functional layer.

4. The method according to claim 1, characterised in that plural outlet openings are provided, wherein the air has a different temperature in a region of at least two of the plural outlet openings, which temperature rises in a direction of a relative movement between the plural outlet openings and the functional layer to be activated.

5. The method according to claim 1, characterised in that the functional layer comprises an element for increasing thermal conductivity through the functional layer selected from the group consisting of polyolefins and metal particles.

6. The method according to claim 1, characterised in that the functional layer is substantially free from absorbers for laser light or other radiation sources.

7. The method according to claim 1, characterised in that the air supplied to the functional layer is partly recovered and can be used at least indirectly via a heat exchanger for heating the supplied air flow.

* * * * *